United States Patent [19]

Haight

[11] Patent Number: 4,875,999

[45] Date of Patent: Oct. 24, 1989

[54] APPARATUS AND METHOD OF CLASSIFYING PARTICLES

[75] Inventor: William J. Haight, Pleasantville, N.Y.

[73] Assignee: Mineral Recovery Corporation, Pleasantville, N.Y.

[21] Appl. No.: 77,049

[22] Filed: Jul. 21, 1987

Related U.S. Application Data

[63] Continuation of Ser. No. 868,154, May 22, 1986, abandoned, which is a continuation of Ser. No. 616,782, Jun. 1, 1984, abandoned, which is a continuation of Ser. No. 475,960, Mar. 16, 1983, abandoned.

[51] Int. Cl.[4] ..... B07B 13/00

[52] U.S. Cl. ..... 209/245

[58] Field of Search ..... 209/245, 254, 326, 332, 209/497, 498, 499, 471, 472, 477, 479, 480, 481, 485; 222/199, 161, 196

[56] References Cited

U.S. PATENT DOCUMENTS

| | | | |
|---|---|---|---|
| 2,946,440 | 7/1960 | Simpson | 209/326 |
| 3,399,771 | 9/1968 | Hryniowski | 209/366.5 |
| 3,530,986 | 9/1970 | More et al. | 209/326 |
| 4,148,725 | 4/1979 | Haight | 209/481 |
| 4,319,995 | 3/1982 | Haight | 209/481 |

FOREIGN PATENT DOCUMENTS

| | | |
|---|---|---|
| 226719 | 1/1960 | Australia . |
| 229001 | 6/1960 | Australia . |
| 235449 | 9/1961 | Australia . |
| 432630 | 2/1973 | Australia . |
| 446002 | 2/1974 | Australia . |
| 457480 | 1/1975 | Australia . |

OTHER PUBLICATIONS

Australian Specification No. 66,011/69, published Jun. 24, 1971.

*Primary Examiner*—Richard V. Fisher
*Assistant Examiner*—Wanda L. Millard
*Attorney, Agent, or Firm*—Morgan & Finnegan

[57] ABSTRACT

Gyratory and reciprocal motion classifiers for classifying particles in a fluidized particle bed according to size or density, and implementing a classification chamber for the fluidized particle bed and an activation chamber for enhancing the kinetic energy of particles prior to their introduction into the classification chamber. The activation chamber is movable with the classifier and preferably has a vertical thrusting surface and lateral surfaces convergent toward an exit opening which admits particles into the classification chamber in proximity to an upstanding surface for dispersing particles away from the point of entry and over and into the fluidized bed in a direction counter to the directional throw of the particle bed-supporting surface of the classification chamber.

26 Claims, 4 Drawing Sheets

APPARATUS AND METHOD OF CLASSIFYING PARTICLES

This is a continuation of co-pending application Ser. No. 868,154, filed on 5/22/86, now abandoned, which is a continuation of co-pending application Ser. No. 616,782, filed on 6/1/84, now abandoned, which is a continuation of application Ser. No. 475,960 filed Mar. 16, 1983 now abandoned.

FIELD OF THE INVENTION

This invention relates to the classification of particulate matter and, especially, to improvements in vibratory and gyratory apparatus and processes for classifying particles in accordance with size, mass, density and the like.

RELATED PATENTS

The present invention is useful in connection with the concepts disclosed in my earlier U.S. Pat. Nos. 4,148,725 and 4,319,995.

BACKGROUND OF THE INVENTION

In gyratory, vibratory and reciprocal type separators, or "classifiers," the particulate matter to be classified forms a particle bed on a supporting surface that is agitated with a gyratory, cyclical or repetitive motion. The gyratory type devices disclosed in the above U.S. Pat. Nos. 4,148,725 and 4,319,995, for example, classify particles of given size according to their relative densities.

Gyratory separators conventionally have been used to classify particles in accordance with size. A typical separator classifier is disclosed in U.S. Pat. No. 2,950,819, in which the particle mixture is placed upon a vibratory screen designed to pass particles of all sizes smaller than the screen openings. Such gyratory screening classifiers, are operated such that oversize particles ordinarily move to the periphery of the screen and are discharged. Particles which are smaller than the screen openings fall through into a collection chamber from which they may be extracted.

Gyratory classification devices, when used to classify particles according to relative density, can be effective classifiers, however, a significant problem has been their limited processing rate. Specifically, such devices have inherent limitations restricting the rate of flow of material to be classified. Attempts to increase the flow rate by speeding up the frequency or intensity of gyratory motion tends to impede the further flow of particles from the feed hopper into the working chamber where the separation occurs. On the other hand, attempts to add particles to the feed hopper at a faster rate only reduces the degree of fluidization of the particle bed and, ultimately, separation simply stops. That is, when material is introduced too quickly, the particles exhibit a significant reduction in activity, which can be observed as packing of the particle bed.

In screening operations, i.e., size classifications, problems are often encountered with very fine particulate matter, such as epoxy powdered material as fine as about 250 mesh. This problem is generally manifested as a "blinding" of the screen. When blinding occurs, the holes of the screen become blocked and no longer permit passage of the fines. Conventional gyratory screening classifiers make use of a gyratory container carrying a horizontal screen upon which particles to be classified are placed. As mentioned above, those particles which are finer than the screen openings fall through into a lower chamber for collection or removal. Coarse particles are ordinarily extracted at the periphery of the screen. These conventional devices sometimes make use of "scrolls" to increase the residence time of particles on the screen. To control the activity of particles on the screen, the components of gyratory motion can be adjusted.

Adjustment of gyratory motion is accomplished by (a) altering the size and relative angular position of the throw weights at the top and bottom of the drive motor and/or (b) by varying the speed of the motor. As a general rule, the bottom weight tends to control the amplitude of the vertical displacement of gyratory motion, whereas the top weight tends to control the degree of eccentricity of the motion when the weights are angularly displaced. In operating screening classifiers, the object is to present the particles to the open apertures of the screen as frequently as possible so that the fines can drop through the apertures before leaving the screen. In order to achieve this object, a balance must be struck between the flow rate through the machine and classification efficiency. Attempts to increase the throughput rate in conventional screening devices have generally resulted in reduced screening efficiency; conversely, attempts to improve efficiency have generally required a reduced rate of throughput.

Similarly, in density classification in which the object is to separate dense or higher mass particles from the bed, the feed rate which can be achieved without overloading the particle bed or diminishing the residence time unacceptably has been restricted. It was found that increasing the frequency of gyration often merely caused particles to back up into the feed hopper. The reason for this behavior of the particles is not completely understood, but appeared to be the result of an increase of pressure in the classification head due to the increased counter throw of the bed supporting surface.

SUMMARY OF THE INVENTION

The present invention improves particle classification methods by permitting a higher degree of fluidization of the particle bed, by permitting higher flow rates to be used at a given efficiency, and by achieving better efficiency at a given flow rate. Briefly, this is accomplished by enhancing the kinetic energy (i.e., activity) of particles before they enter the classification chamber, such that the particles to be introduced overcome the apparent resistance set up by particle activity within the classification chamber. The present invention also induces the particles entering the classification chamber to move in a direction counter to the direction of the thrust, or "throw" of the particle-supporting surface of the bed.

The preferred means for accomplishing this comprises an "activation chamber" which is shaped to enhance the particle activity therein, with an increase of the apparent "pressure" or energy of the particles.

In the case of gyratory motion, the activation chamber takes the form of an annulus, or circle, because the locus of the horizontal eccentic motion component of the gyratory motion is circular. In its cross-section the annulus may be merely rectangular, but preferably the cross-section is defined by a vertical thrusting surface and lateral surfaces convergent toward an exit aperture. This exit aperture is preferably located in proximity to a particle thrusting surface at the interior of the classification chamber. Activated particles are dispersed over the particle bed in a direction counter to the throw induced by the particle bed supporting surface. If the classification motion is primarily reciprocal (back and forth) in the horizontal plane, the activation chamber may be linear, rather than annular.

As a result of preactivating the particle feed entering the classification chamber, classification can be carried out at higher repetitive motion frequencies so as to obtain greater particle activity and a higher degree of fluidization of the particles resident in the classification chamber. Such increased fluidization is attended by a greater recovery of classified particles, i.e., higher yield, and by a capacity for increased rates of particle flow.

The invention will be better understood by reference to the following detailed description and drawings of the preferred embodiments.

DESCRIPTION OF PREFERRED EMBODIMENT

Figure 1:
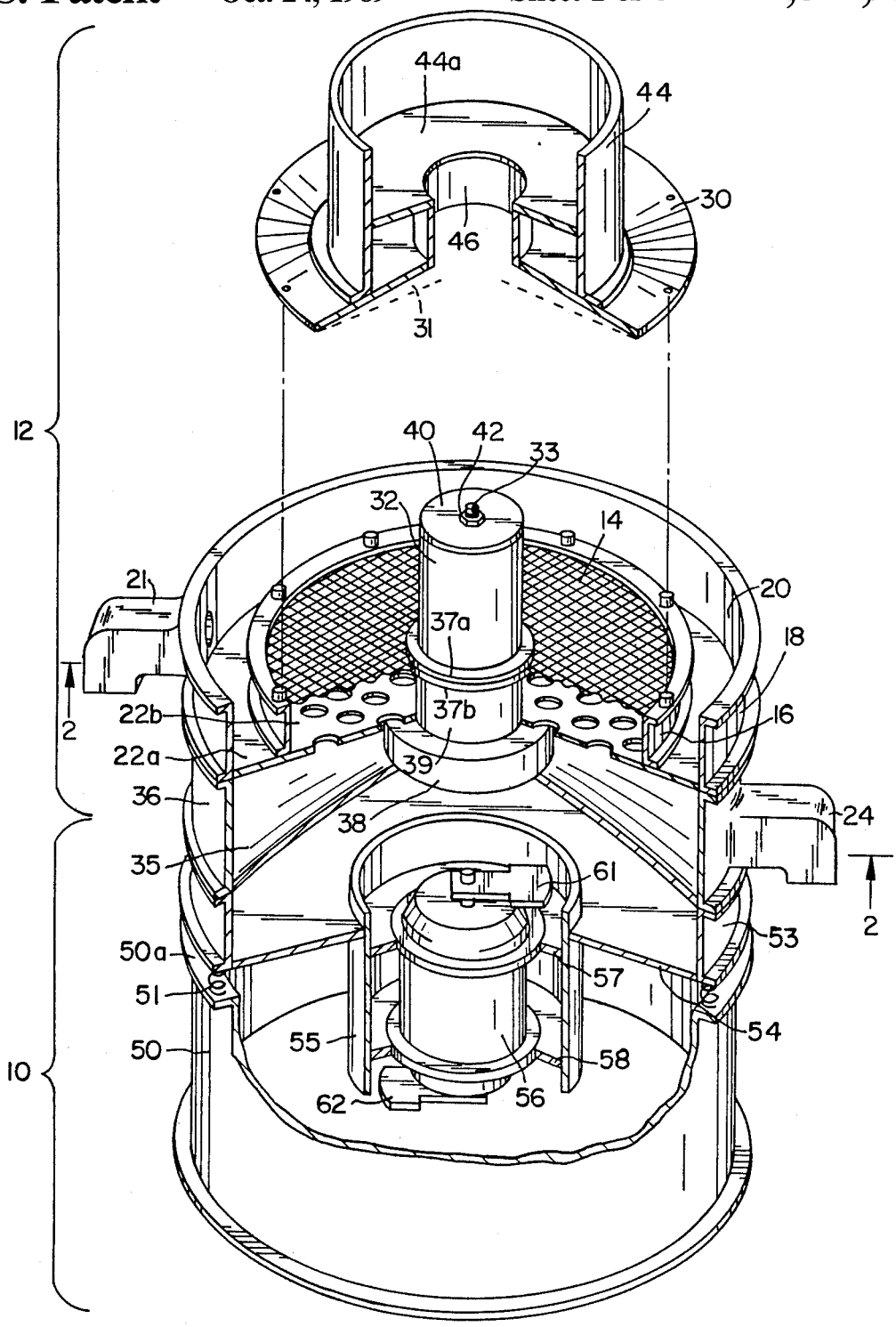
FIG. 1 is a cut-away perspective view of a gyratory screening apparatus implementing the present invention.

Referring first to FIG. 1, the apparatus incorporating the invention includes a gyratory separator machine, designated generally by the numeral 10. It will be understood that the machine 10 is a commercial device which functions to impart gyratory motion to the classification head assembly 12. The classification head 12 includes a working chamber equipped to classify particles according to size. This working chamber comprises a classification surface in the form of a screen 14 carried by a cylindrical frame 16. This frame 16, in turn, is mounted inside a larger cylindrical frame 18 having a floor plate 22 which is solid in the region 22*a* between the frame 18 and rim 20. That region forms a collection channel for coarse particles which do not pass through the screen 14, whereas the fine particles pass through the screen and through the perforated area 22*b* of the floor plate. The coarse particles travel to the perimeter and exit from the waste spout 21, while the fines are recovered from the spout 24. In the region between the screen 14 and the plate 22, conventional screen cleaning elements (not shown) are used, such elements being in the form of several plastic rings having a height approximately the height of the rim 20, or of small rubber balls of lesser diameter.

In accordance with the present invention, the classification head is provided with a laterally extending lid 30 which overlies the classification screen 14 and is vertically spaced from it to form a classification chamber 31 (FIG. 2) which, due to the sloping configuration of the lid, generally decreases in cross-sectional area from the center thereof to the perimeter. This is best observed in the crossectional view of FIG. 2. The lid 30 is spaced from the screen at its perimeter by spacers (not shown) to form an exit gap 26 (FIG. 2) which may be on the order of 1/16–¼ inch in size when classifying typical particulate matter.

Extending upwardly from the surface of the screen 14 is a cylindrical element 32 that functions as a thrusting surface for dispersing particles outwardly over the surface of the classification screen 14. The cylindrical element 32 is held in place by a threaded vertical shaft 33 affixed to the convex floor plate 35 of an intermediate spacing frame 36 associated with the gyratory machine 10. The perforated plate 22 is supported at its center by the vertical collar 38, also affixed to the convex floor plate 35; a spacer cylinder 39 resting on the perforated plate 22 in turn supports the screen 14 at its center. To that end, a pair of washer plates 37*a*, 37*b* clamps the screen and provides a base for the cylindrical thrusting element 32, the entire cylindrical assembly being secured by a further plate 40 and nut 42 at the top.

For the purpose of feeding particles into the working chamber 31, a feed hopper 44 is integrally affixed to the lid 30. The feed hopper 44 is cylindrical in cross-section and includes a cylindrical ring 46 concentric with the element 32 that forms therewith a narrow annular channel 48. This channel 48, which is an important feature in the embodiment of FIGS. 1 and 2, has a circular entrance aperture 49*a* at the top for accepting particles loaded into the feed hopper, and has a circular exit aperture 49*b* at its lower end for admitting particles into the classification chamber. This channel 48 activates the particles accepted from the feed hopper and increases their kinetic energy prior to admitting them into the classification chamber 31. Particles added to the feed hopper are retained temporarily upon the floor 44*a* of the hopper. It will be understood that, when the apparatus is operated, the entire classification head assembly 12 assumes a gyratory motion having both a circularly eccentric motion component and a repetitive vertical motion component.

Gyratory motion is imparted to the classification head 12 by the gyratory separator machine 10. This machine is a standard commercial unit having a mounting base 50, a plurality of compression springs 51 circumferentially spaced about the upper flange 50*a* of the base for supporting a cylindrical motor frame 53. This frame includes a horizontal plate 54 that carries at its center a cylindrical motor mount 55 extending down into the base. A motor 56 is supported within the mount by a pair of horizontal flanges 57, 58. Each of the frames 53, 36, 18 is secured to its adjacent frame by a clamping ring (not shown) at its periphery. In this manner, the entire upper classification section 12 moves with the frame 53. Vibrations induced by the motor are therefore transmitted directly to the frame, and to the upper components mounted to it.

The desired motion is obtained from the eccentricity of the weights 61, 62 affixed to the motor shaft. These weights project horizontally outwardly from the motor shaft, the radial angle between their axes being adjustable by shifting and locking the angular positions of one of the weights relative to the other weight. Thus, the lower weight 62 can be made to lead or lag the position of the upper weight 61 by a selectable angle. Adjustment of these weights alters the characteristics of the resultant gyratory motion.

It was found that good results are obtained when the weights are set to provide a displacement angle of 180°, with the lower weight 62 being heavier than the top weight 61. In practice this was accomplished by inverting the motor of an 18-inch Kason vibratory machine. This brings about a high degree of fluidity in the particle bed by causing the frame 53 to exhibit a large vertical displacement at the perimeter. At the same time, a substantial horizontal eccentric motion is imparted to the frame 53 which, combined with the vertical displacement, induces a net inward thrust (or "throw") to particles contacted by the screen 14.

As is now apparent, the classification head 12 assumes a gyratory motion when the motor is in operation. Such gyratory motion has both a circularly eccentric component and an oscillatory, or repetitive, vertical component. The combination of these two motion components enables energy to be imparted to the particle bed to achieve the desired fluidization. Fluidization of the particle bed within the classification head occurs as a result of the instantaneous spacing between individual particles, as is fully explained in my prior U.S. Pat. No. 4,319,995.

It is, of course, possible to adjust the weights to intermediate angular displacements. It is, however, important that the classification head be given a repetitive horizontal, or lateral, displacement. For gyratory motion, this means that the classification head will have a horizontal eccentric component. As hereinafter explained, this horizontal eccentric component is utilized to disperse newly added particles outwardly into the classification chamber.

SIZE CLASSIFICATION OPERATION

In classifying particles it has been found that best results are achieved when particles have a high degree of fluidization within the classification chamber. This can be observed as an expansion of the inter-particle spacing within the classification chamber. Increased fluidization can be achieved by increasing the frequency of gyration. However, it has also been observed that as efforts are made to increase the motion frequency to enhance fluidity of the particles, the flow rate of particles through the apparatus tends to decrease owing to the inability of particles to enter the classification chamber. It appears that the higher the level of activity within the classification chamber, the less the tendency for particles to enter the chamber. The reason for this phenomenon is not entirely understood; however, it may be analogized to an increase in pressure within the classification head as fluidization increases, this pressure resisting the entry of new particles.

In the present invention, the annular channel 48 formed between the cylindrical element 32 and the cylindrical ring 46 is effective in overcoming this resistance to particle entry by preactivating particles before they are admitted into the classification chamber. In the channel 48, the particles flow in a circular path and also have a complex spinning and bouncing motion. Thus all particles entering the classification chamber 31 have an enhanced level of energy as a result of encountering the closely spaced and eccentrically moving walls of the channel 48.

Particles entering the classification chamber 31 via the particle-introducing channel 48 are admitted adjacent the cylindrical element 32 which, by reason of the eccentric motion component, contacts the admitted particles and disperses them outwardly away from the point of entry to make room for the entry of additional particles. This outward dispersion of particles is in a direction counter to the direction of the inward throw exerted on the particles by the screen 14 and, in some cases, by the lid 30. Outwardly dispersed particles are thus forced against other particles thrown inward by the screen. They are also contacted by the lid and driven against the screen where the fine and course particles become classified. Due to the preactivation of particles by the channel 48, the frequency and/or intensity of motion can by stepped up to enhance the activity within the particle bed and, hence, to enhance the efficiency of operation.

DENSITY CLASSIFICATION

Figure 3:
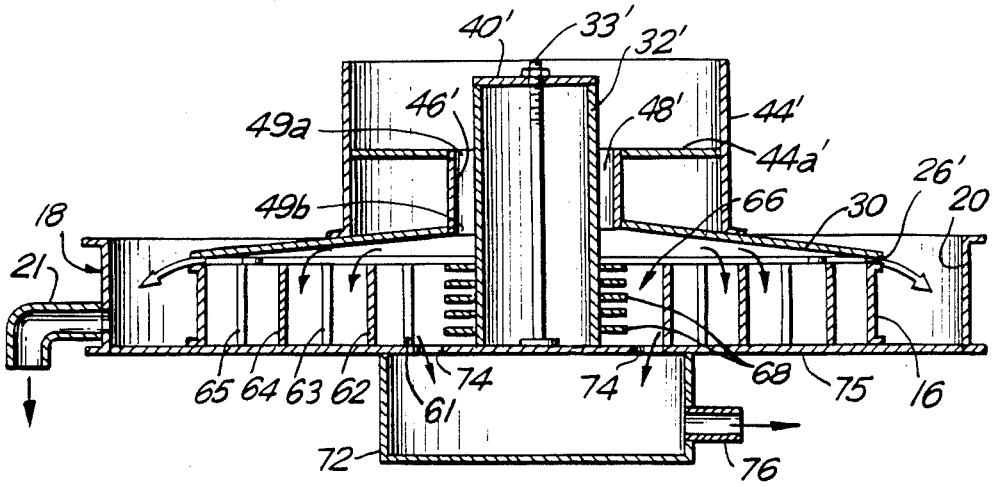
FIG. 3 is a cross-sectional elevational view of a particle separation head incorporating the invention.

FIG. 3 illustrates the configuration of a classification head for separating denser particles from the less dense particles of a size-classified particle mixture. This head is mounted directly to the gyratory separator machine 10. In place of the classification screen 14 are a number of concentric rings 61–65 each having at least one narrow vertical opening so as to form a series of intercommunicating annular channels. Here, the threaded shaft 33 is affixed directly to the floor plate 75. In this configuration (not drawn to scale), which is described in detail in the aforementioned U.S. Pat. No. 4,319,995, a central collection zone 66 at the interior of the ring 61, contains a plurality of spaced-apart horizontal discs 68. These discs maintain fluidization of particles within the collection zone.

Preactivation of particles by the channel 48 and their outward dispersion by the element 32 occur as described above in connection with FIGS. 1–2. Particles within the classification chamber beneath the lid 30' fall into the annular channels, whereby less dense particles in the central collection zone are displaced by particles of greater density, the less dense particles flowing outwardly and ultimately over the frame 16, and into the waste spout 21. The particle concentrate, consisting of a high percentage of particles of greater density, enters a lower collection chamber 72 through extraction ports 72 in the floor plate 75 that supports the particle bed. The concentrate is periodically removed by applying a vacuum to the pipe 76. Alternatively, the concentrate may be permitted to fall into a domed lower frame similar to the frame 36 of FIGS. 1–2 for continuous withdrawal from an exit spout. The dome of such frame may also be provided with a series of stepped circular ridges to disperse the concentrate particles toward the periphery where they can be withdrawn from a spout, such as the spout 24 in FIG. 1.

When apparatus constructed as shown in FIG. 3 was operated, it was found that the frequency and amplitude of gyratory motion could be increased due to activation of the particles in the channel 48. This resulted in a higher degree of fluidization of the particle bed, attended by a faster rate of particle flow through the apparatus, and a higher rate of recovery of dense particles.

Figure 4:
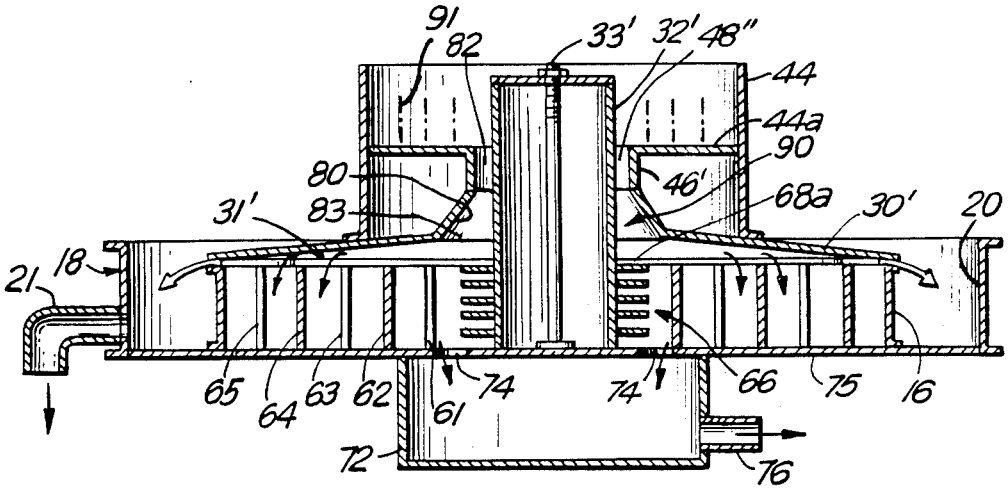
FIG. 4 is a cross-sectional elevational view of a further embodiment of the separation head incorporating the invention.

A further embodiment of the separator configuration is shown in FIG. 4, in which the intermediate activation chamber is shaped to increase the energy level of particles drawn from the hopper, and to introduce particles into the classification chamber at a location, and with a direction, aiding the dispersion of particles over the particle bed against the inward throw of the machine.

(Where appropriate, the same reference numerals have been assigned to like elements).

In FIG. 4, the activation chamber takes the form of an annular channel of triangular cross-section overlying the uppermost disc 68a, combinded with an upper channel 48" similar to channel 48'. The channel 48" is rectangular in cross-section and is formed between the element 32' and the cylindrical wall section 46'. The channel 48" activates the particles in the manner described above in connection with FIG. 3.

The triangular channel configuration is defined by three primary surface elements: the horizontal top disc 68a; a vertical thrusting surface provided by the cylindrical element 32'; and an angled, laterally extending segment 80 of the lid 30'. These elements also define an entrance aperture 82 at the top of the triangle where preactivated particles enter the triangular channel 90 from the upper channel 48", or chamber 48". The elements 68a and 80 converge from the thrusting surface of the elements 32' toward an exit aperture 83 at the opposite end of the triangular chamber. The foregoing three elements and the entrance and exit apertures together thus form a second particle activation chamber 90, or compression chamber of tapering cross-section which further activates particles entering the classification chamber from the upper activation chamber 48". Thus, particles flowing into the compression chamber 90 are driven outwardly and downwardly toward the exit aperture 83 upon being contacted by the surfaces of elements 32' and 80. This results in a further increase in the energy of particles entering the working chamber 31'.

The surface of element 32' furthermore functions as a dispersing surface to contact the activated particles and drive them outwardly against the inward throw exerted on particles by the elements within the classification chamber. Thus in the embodiment of FIG. 4, the dispersing surface for the particles is integral with the activation chamber.

It should be remarked that the annular compression chamber configuration of FIG. 4 is equally advantageous when used with the gyratory screening apparatus of FIG. 1. Additionally, it is possible to implement a plurality of annular rings in the position indicated by the phanton lines 91 in FIG. 4, in order to assist in the feeding of particles into the entance aperture 82. Such rings form annular channels and the rings are either ported or are spaced from the hopper floor 44a in order to permit particles to flow from the outer channels to the inner channels.

The presence of an activation chamber has been found to permit classifying to occur at higher gyratory speeds with higher rates of throughput and higher recovery of classified particles. The following examples are illustrative.

EXAMPLE I

Figure 2:
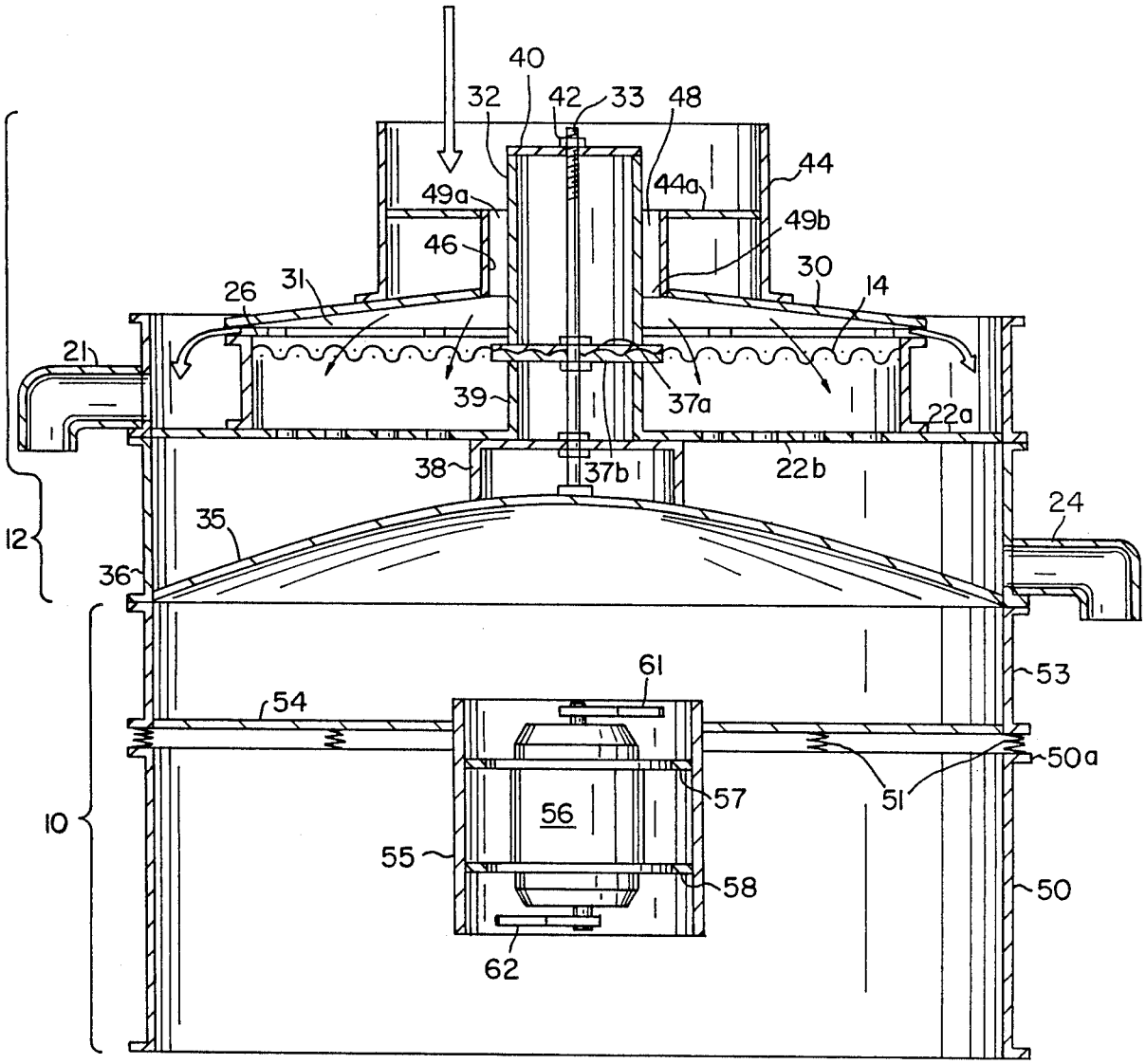
FIG. 2 is a elevational view in cross-section of the working chamber of the gyratory apparatus in FIG. 1, taken generally along the line 2—2 in FIG. 1.

The classification embodiment of FIGS. 1 and 2 (machine #1) was operated and compared with a standard 18-inch diameter Kason vibro screening machine (machine #2), with each device equipped with screens of identical mesh size. Three different screen sizes were used; in which a given amount of sand was fed into each machine until all the sand particles were classified into fines and oversize. The fines and oversize were weighed and the time taken for classification was recorded. The results were as follows:

| | |
|---|---|
| Test 1: | 49 lbs of −25+30 mesh sand, 30 mesh screen |
| Machine #1: | 19 lbs of fines in 16 minutes |
| Machine #2: | 13 lbs of fines in 15 minutes, 50 seconds |
| Test 2: | 50 lbs of −60+170 mesh sand, 100 mesh screen |
| Machine #1: | 14 lbs of fines in 21 minutes, 30 seconds |
| Machine #2: | 13.5 lbs of fines in 36 minutes |
| Test 3: | 5.5 lbs −170+300 mesh epoxy powder, 250 mesh screen |
| Machine #1: | 4.9 lbs of fines in 7 minutes |
| Machine #2: | Screen blinded, unable to classify |

The above qualitative tests indicate the improvements in classifcation achieved with the present invention. Specifically, the invention provides either higher throughput, greater efficiency, or both. Thus, in Test 1. the recovery improved by 45% whereas, in Test 2, the throughput rate for the same recovery increased by 67%. In Test 3, the invention permitted 96% recovery of −250 mesh epoxy powder which, in the same test, the standard commercial machine was unable to classify.

EXAMPLE II

An apparatus was constructed as shown in FIG. 4 (but without the chamber 48") with the following dimensions:

| Element | Dimension |
|---|---|
| surface 80, length | 1.375 inches |
| aperture 82 | .25 inches |
| thrusting surface 32', length | 1.125 inches (distance from aperture 82 to disc 68a) |
| disc 68a, radius | .875 inches (distance from element 32' to edge of 68a) |

Forty-one (41) pounds of −16+30 sand and 1.45 grams of −16+30 iron shot were mixed together. Nine (9) pounds of clean sand was distributed inside the annular channels between rings 61–64. The motor weights were set at 180° with the weight distribution being 3 standard Kason small weights at the top and 4 standard Kason heavy weights at the bottom. The motor was started and operated at 1650 rpm, and the sand/shot mixture added to the hopper at the rate of 18 lbs. per minute. Flow was continuous through the apparatus until all 50 pounds of feed material was depleted and no further flow of waste was observed. The results of the test were as follows:

| Location of material | Weight Sand | Weight Iron Shot |
|---|---|---|
| concentrate withdrawn from collection chamber 72 | 8 lbs. | 12.0 grams |
| Channels | 2 lbs. | 1.3 grams |
| Waste | 40 lbs. | .3 grams |
| Total | 50 lbs. | 13.6 grams |

The foregoing results show a 91.7% (13.3 grams) recovery of the iron shot, with 0.9 grams shot being unaccounted for. Compared with the apparatus shown in FIGS. 1–3 of U.S. Pat. No. 4,319,995, implementation of the activation chamber increased the obtainable rate of flow through the apparatus by a factor of almost 2, and increased the total recovery of iron shot from the mixture by about 15% in one pass.

EXAMPLE III

An apparatus as shown FIG. 3 was constructed and operated under the following conditions:

| Element | Dimensions |
|---|---|
| Element 32', diameter | 3 inches |
| Ring 46', inside diameter | 3.75 inches |
| Ring 46', height | 2.25 inches |
| Channel 48, width | .375 inches |
| Distance between ring 46 and disc 68a | .750 inches |
| Exit aperature gap 26' | .125 inch |

Fifty-seven (57) pounds of −16+30 mesh sand was admixed with 15 grams of −16+30 mesh iron shot. The channels (between elements 61–64 and 16) were filled with an additional nine (9) pounds of clean sand. The motor was brought to an operating speed of 1650 rpm, same weight settings as Example II, and the sand/shot mixture was poured to the feed hopper 44 at the rate of about 18 lbs. per minute until exhausted. At that time, with the motor still running, eight pounds of concentrate was withdrawn from the chamber 72 in fifteen seconds, leaving two pounds of material in the channels. During the approximately 3½ minute test, 66 pounds of waste material were ejected. The results are tabulated below:

| Location of material | Weight Sand | Weight Iron Shot |
|---|---|---|
| Concentrate withdrawn from chamber 72 | 8 lbs. | 11.6 |
| Channels | 2 lbs. | 2.6 grams |
| Waste | 66 lbs. | .8 grams |
| Total | 76 lbs. | 15.0 grams |

The recovery of iron shot from the mixture was about 95%.

RECIPROCAL MOTION CLASSIFICATION

Figure 5:
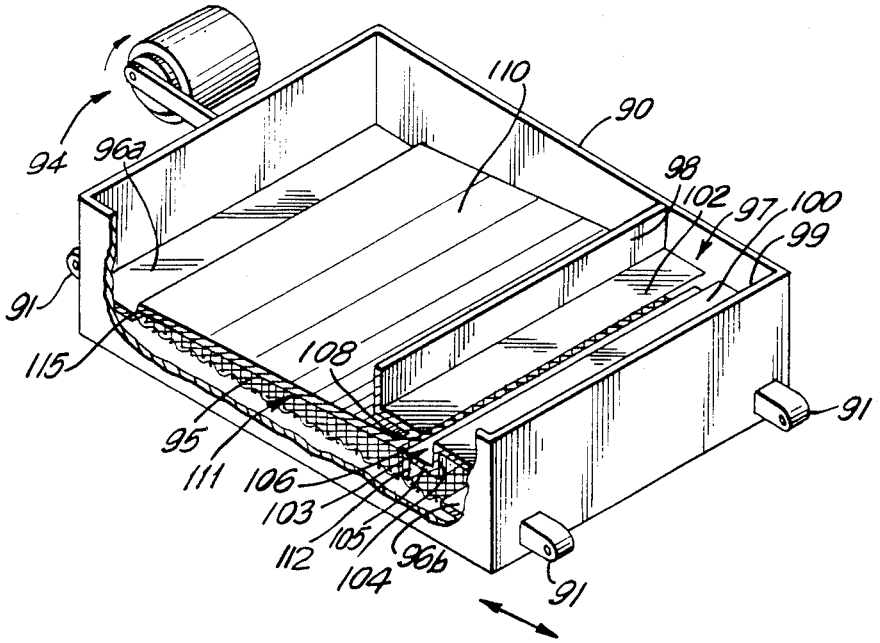
FIG. 5 is a partially cut-away perspective view of a reciprocal motion screening apparatus implementing the present invention.
Figure 6:
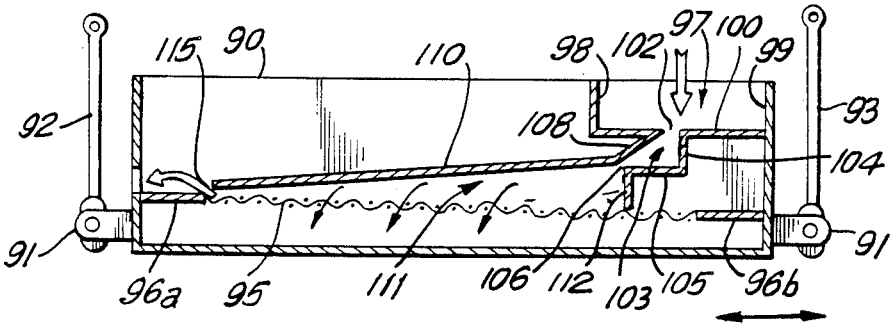
FIG. 6 is a cross-sectional view in elevation of the apparatus in FIG. 5.
Figure 7:
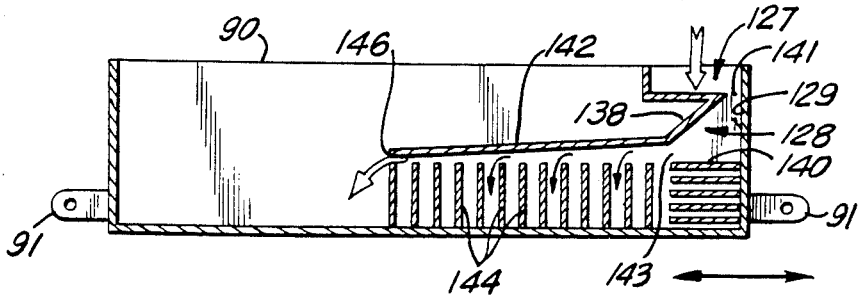
FIG. 7 is a schematic representation in elevation of a reciprocal motion apparatus, similar to that of FIG. 4, incorporating the invention and useful in classifying the particles according to density.

FIGS. 5–7 depict the implementation of the invention in classification apparatus using reciprocal, primarily horizontal motion (as distinguished from gyratory motion) of a particle bed-supporting surface. Referring to FIG. 5, the apparatus comprises a horizontal rectangular frame 90 supported at its four corners by hinge fittings 91 for suspension by rods 92,93 from cradle (not shown). The entire frame is arranged for a back and forth reciprocal motion over a limited distance, e.g., 0.25–0.50 inches. The rods 92 at one end of the frame are slightly shorter than the rods 93 supporting the opposite end of the frame. The frame 90 is reciprocally moved by a motor-driven eccentric mechanism 94, illustrated schematically in FIG. 5. As a result of the difference in length between the rods 92,93 a slight lifting motion occurs at the left end of the frame as the frame moves to the right. The rectangular frame and drive mechanism is a commercial screening apparatus manufactured by R.I.D. (Switzerland). It should be understood that the frame 90 can take other forms and can be supported and driven by other means. For example, the entire frame may be supported on roller bearings, slides, rocker arms etc. It is further noted that the apparatus shown in the drawings is primarily a configuration used to demonstrate the effectiveness of the invention when reciprocal linear motion is isolated from the circulatory eccentric component of gyratory motion.

As shown in FIGS. 5 and 6, the frame supports a screen 95 suspended generally horizontally over the bottom of the frame, and at each end of the frame is a flate plate **96*a*, 96*b*, which may be displaced vertically relative to one another to change the angle of the screen. As shown, the plate 96*a* is at a slightly higher vertical elevation than the plate 96*b***, so that the screen slopes upwardly from right to left.

The apparatus includes a feed hopper 97 defined between the back wall 99 of the frame, the frame sides and a transversely extending vertical wall 98. The hopper, of course, may be made higher or otherwise changed in dimension. The floor surface 100 of the feed hopper is formed with a slot 102 communicating with a linear compression chamber 103 of triangular cross-section. This compression chamber, or particle activation chamber, is bounded by the vertical thrusting wall 104, a horizontal surface element 105, and a sloping surface 108 extending between the entrance aperture 102 and an exit aperture 106. A sloping lid 110 supported above the screen 95 and forming therewith a classification chamber 111, extends from the aperture 106 at one end to an elongated exit aperture 115 at the other end. Particles enter the classification chamber at a point adjacent the vertical step 112, which functions as a dispersing surface to propel particles over the particle bed toward the exit aperture 115 and counter the direction of throw provided by the bed-supporting screen 95.

In operation, particles to be classified are loaded into the feed hopper 97 from which they pass through the entrance aperture 102 into the activation chamber 103. The reciprocal motion of the frame, and of the elements carried therein, results in the contacting of the particles by the surfaces of the activation chamber in such a way that the particles are caused to be driven toward the aperture 106 and into the classification chamber 111 formed between the screen 95 and the downwardly sloping lid 110. These activated particles are given further thrust, in opposition to the throw of the machine, as they encounter the reciprocally moving vertical dispersing surface 112. Once inside the classification chamber, the particles are classified according to size by the screen 95. The fines drop through the screen and are collected in the space beneath the screen. Coarse particles continue to travel away from the dispersing surface 112 toward the exit aperture 115 at the far end of the sloping lid 110. The frame includes a channel (not shown) for extracting the oversized material.

The following example illustrates a typical screening operation using reciprocal motion.

EXAMPLE IV

The apparatus was arranged as shown in FIGS. 5–6, with the dimension of the elements as follows:

| Element | Dimension |
|---|---|
| Screen | 17 L × 11 W in. |
| Feed hopper 97 | 4.5 L × 11 W × 3 H in. |
| Vertical element 104, height | 2.25 in. |
| Sloping surface element 108 | 2.75 in. |
| Entrance aperture 102, gap width | 0.5 in. |
| Lid 110, length | 13 in. |
| Exit aperture 106, gap width | 0.5 in. |
| Horizontal surface 105, length | 2 in. |
| Thrusting surface 112, height | 1 in. |
| Exit aperture 115 | 0.2 in. |

The material to be classified consisted of 37 lbs. of $-\frac{1}{8}+1/16$ sand. The screen 95 was $\frac{1}{8}$ inch square mesh and the motor/eccentric drive was operated at 1200 rpm in the direction shown by the arrow. The sand was poured into the hopper 97 to achieve a rate of flow of 12 lbs. per minute. Flow of the material was uphill and against the throw of the apparatus. At the end of approximately 3 minutes, the apparatus was stopped and the classified sand was weighed. Fines measured 27 lbs. of sand (passed through the screen), 1 lb. of sand was recovered as coarse and 9 lbs. of unclassified sand remained in the unit.

It should be noted that the activation chamber operates in such a manner that the particles entering the classification chamber have a level of activation which assists in their dispersion against the throw of the machine. The activation chamber is characterized by a geometry such that its movement activates the particle and causes them to flow into the entrance aperture and out of the exit aperture in a preferred direction. In the machine shown in FIGS. 5 and 6, for instance, the reciprocal motion of the frame causes the thrusting surface 104 of the activation chamber to drive particles between the convergent elements 105, 108 toward the exit aperture 106. Thus, as particles are contacted by the thrusting surface 104, they are simultaneously "squeezed" between the surface elements 105, 108, and the small activation chamber 103 accordingly functions as a compressor. In an experiment in which the activation chamber was reversed left-to-right, to have its exit aperture facing the dispersing surface 112 rather than the aperture 115, flow through the apparatus was negligible.

Turning to FIG. 7, there is shown a scheme for classifying particles according to density using reciprocal motion. The FIG. 7 apparatus comprises a feed hopper 27, a triangular activation chamber 128 formed between surface elements 129, 138 and the top plate 140*a* of a stack of vertically spaced-apart horizontal plates 140. The activation chamber communicates with the hopper via the particle entrance aperture 141, and has an exit aperture 143 for admitting particles into the classification chamber. Underneath a downwardly sloping lid 142, a series of mutually spaced vertical baffle plates 144 having vertical slots (not shown) to form a plurality of intercommunications, laterally-extending channels. These channels allow particles of greater density (or mass) to enter in preference to particles of lesser density. The space between the particle occupying the channels and the sloplng lid 142 constitutes a classification chamber, the exit 146 of which is between the last vertical baffle plate 144 and the lower edge of the lid.

In operation, the frame 90 is given a reciprocal motion by the eccentric motor drive, and particles are added to the hopper 127, from which they pass through the entrance aperture 141 into the activation chamber 128. Their kinetic energy is raised by repetitive contact with the thrusting wall 129 and sloping element 138. Preactivated particles thereupon enter the classification chamber via the aperture 143, where they have a net motion in the direction of the classification chamber exit 146. As particles traverse the distance between the activation chamber 128 and the exit 146, they may enter the channels defined between vertical plates 144. Particles striking the sloping lid 142 are driven downwardly into the channels and, in this case, particles of greater density tend to be driven into the channels in preference to particles of lesser density, the latter being displaced. The stack of horizontal plates 140 serves to damp particle activity in the collection zone immediately below the activation chamber.

EXAMPLE V

The apparatus of FIG. 7 was constructed with the following dimensions:

| Element | Dimension |
|---|---|
| Aperture 141 gap width | 0.5 inch |
| Aperture 143 gap width | 0.5 inch |
| Length of sloping surface 138 | 3 inches |
| Height of thrusting surface 129 | 2.5 inches |
| Height of vertical plates 144 | 2 inches |
| Length of horizontal plates 140 | 2.5 inches |
| Length of lid 142 | 6.5 inches |
| Area of frame occupied by channels (including plates 140) | 72 square inches |
| Height of aperture 146 | 0.25 inch |
| Width of all elements | 8.5 inches |

The foregoing apparatus was operated under the following test conditions: Seven (7) pounds of $-\frac{1}{8}+1/16$ mesh sand was loaded into the channels prior to the test. Twenty-six (26) pounds of $-\frac{1}{8}+1/16$ sand was admixed with 15 grams of $-\frac{1}{8}+1/16$ mesh iron shot. The eccentric motor drive was operated at a speed of 1500 rpm, and the sand/shot mixture was poured into the hopper at the rate of 14.9 lbs. per minute. At the conclusion of the pour, the following measurements were made:

| Location of Material | Weight Sand | Weight Lead Shot |
|---|---|---|
| first channel, among plates 140 | 3.5 lbs. | 4.7 grams |
| remaining channels | 3.0 lbs. | 3.9 grams |
| Waste | 26.5 lbs. | 6.4 grams |
| Total | 33.0 lbs. | 15.0 grams |

It is seen that the rate of recovery in this apparatus was approximately 60% from about 72 square inches of channels in one pass. Although this rate of recovery is less than was obtained with gyratory apparatus, separation was nevertheless appreciable.

From the preceding, it is noted that the process effected by the invention offers significant improvements in the ability of gyratory and reciprocal equipment to accept higher rates of flow during classification of particles. Moreover, by implementing a classification chamber and by preactivating particles, conventional screening apparatus can be operated at higher throughput rates and with particles having a degree of fineness which could not previously be classified by ordinary methods.

Although the invention has been described with reference to the preferred embodiments, it should be understood that certain modifications and variations will occur to those skilled in the art without departing from the spirit and scope of the invention.

I claim:

1. In an apparatus for classifying particles and having a screen for separating undersized particles from a mass of particles carried thereby, the apparatus having means for imparting gyratory motion to the screen, said motion having a laterally eccentric component and a repetitive vertical component for fluidizing and resulting in directions of flow of particles on the screen and providing a radially directed throw, the improvement comprising:

a lid overlying the screen, said lid defining with said screen a classification chamber and providing a reaction surface for contacting active particles in said chamber, said chamber having an exit for oversized particles located along the circumference of said apparatus; and means for introducing particles into said chamber at a portion thereof located radially distant from said exit, and means for dispersing introduced particles across the surface of the screen toward said exit in a direction opposite to the direction of said throw.

2. Apparatus according to claim 1, further comprising:

activation means associated with the particle introducing means and movable with the classification chamber for enhancing the activity of introduced particles.

3. Apparatus according to claim 2, wherein the activation means comprises:

an annular activation chamber having entrance and exit apertures, said annular activation chamber being shaped to cause particles therein to flow from said entrance aperture in a direction toward said exit aperture, said exit aperture being located to introduce particles into the classification chamber.

4. Apparatus according to claim 3, wherein the dispersing means includes an upstanding surface in the classification chamber for contacting and dispersing introduced particles, and the exit aperture is located to introduce particles into said classification chamber adjacent the particle dispersing surface and to be contacted thereby, said particles being further activated and dispersed in a direction opposite to the direction of inward throw upon being contacted by said particle dispersing surface.

5. Apparatus according to claim 3, wherein:

the annular activation chamber includes a thrusting surface and diminishes in cross-sectional area from said thrusting surface to the exit aperture, the entrance aperture being located adjacent said thrusting surface at one end of said annular activation chamber and said exit aperture being located at an opposite end of said annular activation chamber.

6. Apparatus according to claim 3, wherein:

the entrance and exit apertures are annular.

7. Apparatus according to claim 2, wherein:

the activation means comprises an annular channel disposed above the lid and between the chamber and a source of particles to be classified, said annular channel admitting particles into said chamber adjacent the particle dispersing means.

8. Apparatus according to claim 1, wherein:

the lid is angled relative to the screen such that the classification chamber decreases in cross-sectional area between the particle introducing means and the exit.

9. In a gyratory particle classification apparatus, the improvement comprising, in combination:

a gyratory motion working chamber defined by a particle bed-supporting surface providing a net radial throw and on which a fluidized particle bed is formed, a lid extending over the particle bed-supporting surface and disposed to contact fluidized particles in said fluid particle bed, the working chamber having an exit aperture for rejected particles; and means for introducing particles from a particle source into said working chamber which are located radially distant from said exit aperture and which are effective to enhance the activity of source particles entering said working chamber and to disperse the activated particles toward said exit aperture into said fluidized particle bed in a direction counter to the direction of net radial throw, and overcome the resistance of said fluidized particle bed to the introduction of source particles into said working chamber.

10. Apparatus according to claim 9, wherein the means for introducing particles from a particle source comprises:

a particle activation chamber having particle entrance and exit openings, said activation chamber being shaped to induce activated particles therein to flow from said entrance opening to said exit opening and to enter the working chamber in a direction counter to the direction of net radial throw.

11. Apparatus for classifying particulate material, comprising:

means for defining a particle classification chamber including a particle bed-supporting surface on which a fluidized particle bed is formed, a laterally extending surface spaced above the particle bed-supporting surface and an exit aperture for removing excess particulate material;

means for imparting to said classification chamber a repetitive motion having at least a generally horizontal component fluidizing the particle bed and imparting a net directional throw to the particles of said particle bed, and giving a downward motion component to particles contacted by said laterally extending surface; and means for introducing activated particles into said classification chamber located distant from said exit aperture and to disperse said activated particles toward said exit aperture in a direction counter to the net directional throw and overcome the resistance of the fluidized bed to the addition of particles thereto.

12. Apparatus according to claim 11, further comprising:

an upstanding dispersing surface in the classification chamber for contacting particles therein, the particles from the means for introducing activated particles being admitted into said classification chamber at a location adjacent said upstanding dispersing surface.

13. Apparatus according to claim 12, wherein:

the upstanding dispersing surface is integral with the activation chamber.

14. Apparatus according to claim 11, wherein the means for introducing activated particles comprises:

an activation chamber having a thrusting surface, bounding surfaces converging from said thrusting surface toward an exit aperture at an opposite end of said activation chamber, and an entrance opening for admitting particles into said activation chamber disposed at a point displaced from the exit aperture thereof, said activation chamber being movable with the classification chamber, the movement thereof imparting a net level activation sufficient to particles entering therein to overcome the resistance of the fluidized bed to the addition of particles thereinto.

15. Apparatus in accordance with claim 11, wherein:

the particle bed-supporting surface of the classification chamber comprises a classification screen through which undersized particles may pass and are collected at a point therebelow, while oversized particles may exit from said classification chamber via the exit aperture thereof.

16. Apparatus according to claim 11, further comprising:

means for imparting a repetitive vertical motion component to the particle supporting-bed which tends to increase the net directional throw.

17. Apparatus in accordance with claim 11, further comprising:

a series of laterally spaced, upstanding baffles disposed in the classification chamber below the laterally extending surface for establishing a plurality of intercommunicating, laterally spaced retention regions for collecting particles of relatively greater mass.

18. Apparatus according to claim 11, wherein:

the particle bed-supporting surface slopes upwardly from the dispersing surface towards the exit aperture.

19. In apparatus for classifying particles, the combination of:

a working chamber having a generally horizontal surface for supporting a bed of particles, an upstanding surface for contacting and dispersing particles over said general horizontal surface, an exit aperture remote from said upstanding surface for contacting and dispersing particles into said bed of particles, and a lid spaced above said surface for supporting particles and convergent therewith toward said exit aperture;

means for agitating said working chamber with a repetitive motion having a generally horizontal motion component fluidizing a bed of particles formed on said generally horizontal surface and imparting to said aperture a net throw in a direction counter to the movement of the particles in said working chamber which is in a direction from said upstanding surface for contacting and dispersing particles into said bed of particles and toward said exit aperture; and a particle activation chamber, located distant from said exit aperture of said working chamber, movable with said working chamber and having a particle exit for admitting particles into said working chamber in proximity to said upstanding surface for contacting and dispersing particles into said bed of particles;

said particle activation chamber being shaped to activate and induce in the particles therein a net movement in a direction generally parallel to the locus of the repetitive generally horizontal motion component.

20. In a gyratory apparatus for classifying particles according to size, the apparatus having a frame, a particle supporting classification surface permitting undersize particles to pass therethrough, and means for agitating said frame with gyratory motion and fluidizing the particles on said particle supporting classification surface and exerting thereon a net radial throw, the improvement comprising:

a laterally extending lid spaced vertically above said particle supporting classification surface and defining therewith a classification chamber having an exit aperture for oversise particles; and means located radially distant from said exit aperture for admitting particles into said classification chamber and activating and imparting to particles entering said classification chamber a directional movement which is counter to the direction of net throw of said apparatus, and dispersing said activated and admitted particles toward said exit aperture of said classification chamber.

21. Apparatus according to claim 20, wherein:

the means for admitting particles into the classification chamber comprises another chamber disposed above and movable with the frame for receiving particles to be classified, said other chamber having an exit opening for admitting said particles continuously into said classification chamber, said other chamber being effective to increase the kinetic energy of particles entering said classification chamber to a degree sufficient to overcome the resistance of fluidized particles in the classification chamber to the introduction of particles to be classified therein.

22. Apparatus according to claim 21, wherein:

the classification chamber has a surface for contacting and dispersing activated and admitted particles over the classification surface, the exit opening of the other chamber being located in proximity to said surface for contacting and dispersing activated and admitted particles over said classification surface.

23. Apparatus according to claim 22, wherein:

the lid is angled relative to the classification surface and the classification chamber decreases in cross-sectional area between the surface for contacting and dispersing particles over said classification surface and the exit aperture.

24. Apparatus according to claim 21, wherein:

the other chamber has at least two surfaces which converge toward the exit opening.

25. In a process for classifying the particles in a particle bed within a classification chamber having an inlet and an outlet, wherein the chamber is agitated with a repetitive motion having at least a generally horizontal motion component for fluidizing the particle bed, the steps of:

providing a source of particles at a given rate to an activation chamber having an inlet and an outlet for the passage of particles therethrough;

agitating said activation chamber with a repetitive motion to enhance the activity of particles passing therethrough from said source of particles; and introducing activated particles into said classification chamber;

said activated particles being introduced into said classification chamber distant from the outlet thereof and having a directional motion tending to disperse such activated particles over said particle bed and away from the location of introduction thereof, and enabling thereby a continuous flow of particles from said source of particles through said activation chamber and into said classification chamber, said classification chamber having a motion providing a net inward directional throw to particles in the particle bed, and the directional motion of activated particles introduced into said classification chamber being counter to said net inward directional throw.

26. The process of claim 25, wherein:

the activation chamber is movable with the classification chamber.

* * * * *